US005504975A

United States Patent [19]

Bar et al.

[11] Patent Number: 5,504,975

[45] Date of Patent: Apr. 9, 1996

[54] METHOD AND APPARATUS FOR NOIL REDUCTION IN WOOL COMBING

[75] Inventors: Herzel Bar, Bat-Yam; Amotz Weinberg, Tel-Aviv, both of Israel

[73] Assignee: Shenkar College of Textile Technology & Fashion, Ramat Gan, Israel

[21] Appl. No.: 417,806

[22] Filed: Apr. 6, 1996

[51] Int. Cl.[6] ..... D01G 19/30

[52] U.S. Cl. ..... 19/66 R; 19/66 CC

[58] Field of Search ..... 19/66 R, 66 CC, 19/115 R, 115 B, 2

[56] References Cited

U.S. PATENT DOCUMENTS 4,989,297 2/1991 Yicheskel et al. ..... 19/66 CC X 5,003,670 4/1991 Waeber et al. ..... 19/66 CC

*Primary Examiner*—John J. Calvert

*Attorney, Agent, or Firm*—Edwin D. Schindler

[57] ABSTRACT

A method and apparatus for combing wool in which the wool is heated prior to being fed to the combing process. The wool is heated by heat rollers or other means to a temperature such that it becomes more plasticized and better lubricated due to the liquification of the natural fat of wool which then acts better as a lubricant. As a result of this process, there is a reduction in the amount of noil produced. The invention is also applicable to various other animal-based natural fibers.

8 Claims, 1 Drawing Sheet

METHOD AND APPARATUS FOR NOIL REDUCTION IN WOOL COMBING

FIELD OF THE INVENTION

Figure 1:
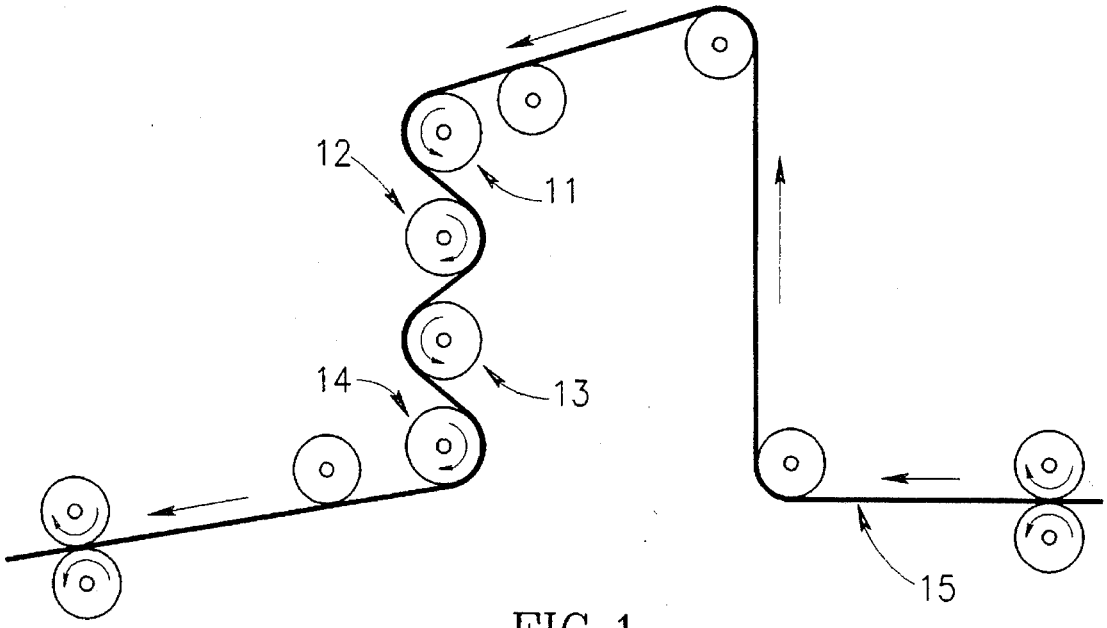

The present invention relates to the process of combing of animal based natural fibers, more specifically, wool fibers.

BACKGROUND OF THE INVENTION

Wool combing is an important step in the manufacture of worsted yarns. The wool, after carding or "preparing", is passed through a combing machine which continues the process, combing out short fibers and aligning the long fibers accurately alongside each other. The combed wool coming out of this process in the form of an untwisted strand called 'top', is then drawn out into roving and spun by twisting it into a yarn. The long fibers, lying parallel to one another in the combed roving, are able to cling tightly together on twisting to form a fine strong worsted yarn. During the process of combing, a certain proportion of fibers is broken and removed in this process as noil.

The most commonly used combing machine is the French (or Continental) machine which is typically used for combing of "thin" fibers (e.g. cross-breds) with a length of 90 mm to 250 mm. Whatever type of combing machine is used, a "comb" which will generally comprise a plurality of pins, tines or the like) is drawn relatively through the previously carded wool sliver. During this combing process, the long wool fibres in the sliver are arranged in generally parallel formation, and unwanted material is removed from the sliver. This unwanted material includes short fibres, the so-called "noil", which need to be eliminated because it is the longer fibres which contribute to the strength of the yarn. However, the mechanical action of the comb in passing through the wool will cause some fibre breakage and formation of additional noil.

It has previously been proposed to heat the pins of a Noble (or English) comb with view to improving combing performance, see for example Brearley, A., "Worsted", Sir Isaac Pitman & Sons Ltd., 1964 which discloses at page 45 the provision of a steam-chest beneath the large circle to provide heat for softening the oil on the fibres and facilitating the drawing of the fibres through the pins.

The fact that a slightly lower percentage of noil is obtained by heating the pins of the Noble Comb, has been confirmed by Townend, et al, see "The scientist looks at the Wool Industry-Combing"—Wool Sci. Rev., 3, No. 11 (1953).

A study on the effect of heating the top comb in rectilinear combing has been reported by Godawa and Turple (see Sawtrl Bulletin, September 1974, Vol. 8, pages 48–55) who conclude that percentage noil decreased slightly as the temperature of the top comb was increased from room temperature to 60° C., with apparently no further reduction when the top comb was heated above 60° C.

SUMMARY OF THE INVENTION

It is an object of the present invention to reduce the formation of noil during a wool combing process.

Although described with reference to wool, the invention is equally suited for other animal-based natural fibers.

According to the present invention, there is provided a method of combing wool wherein the wool fed to the comb has been pre-heated to a temperature such that it plasticizes (becomes more pliable), and where the natural fat of the wool on the fibre surface acts at such temperature as a lubricant to reduce the friction between the wool and the comb.

According to another aspect of the present invention, there is provided a wool combing apparatus wherein upstream of the combing mechanism there are provided heating means to heat the wool to be combed to a temperature such that the wool fibres are plastified and the natural fat in the wool acts as a lubricant to reduce friction between the wool and the comb. The apparatus does not cause any reduction in the speed of the combing process.

The invention is based on our discovery that a significant improvement in the reduction of noil may be obtained by heating the wool upstream of the comb. In contrast to the prior art discussed above, in which the tines of the comb are heated, we believe that the improvements obtained by this invention are due to the increased time available for heat transfer within the wool between the actual heating stage and the action of the comb, as well as the increased time for natural fat of wool to flow on the fibres. However, we do not wish to be bound by this theory of our explanation of the invention.

The wool is preferably heated by a contact method, e.g. heated rollers, but may be heated in other ways, e.g. by microwave, radio frequency heating or direct steaming. Whatever heating method is used, its purpose is to heat the wool to a sufficient temperature so that it plasticizes and the natural fat improves the lubricity of the wool, thereby reducing friction between the wool and the comb. As a result, there is less fibre breakage. Typically the wool will be heated to a temperature at which the natural fat of wool liquefies. Generally this temperature will not exceed 90° C.

Figure 2:
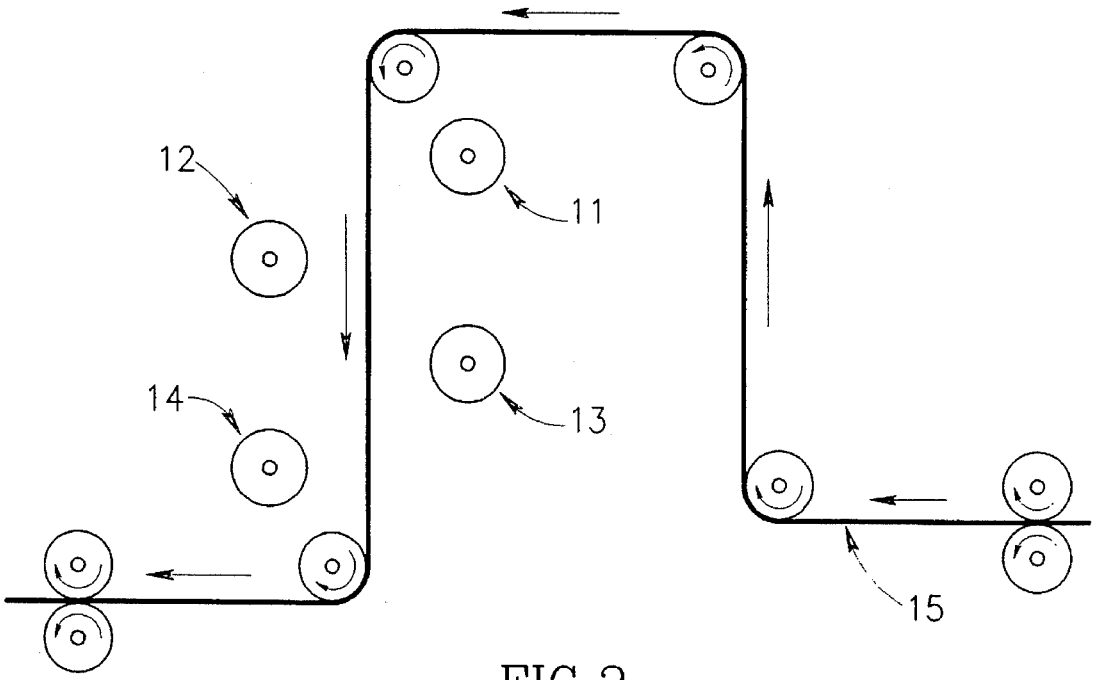

The invention will be further described, by way of example only, with reference of the accompanying drawing, in which:

FIG. 1 diagrammatically illustrates a heating roller assembly in a "closed" position; and FIG. 2 is similar to FIG. 1 but illustrates such roller assembly in an "open" position.

Referring to FIG. 1, there is diagrammatically illustrated a roller assembly which is provided upstream of the conventional wool comb (not illustrated) which will for preference be of the Continental (or French) type. The roller assembly is in the form of a tower of four heated rollers 11, 12, 13 and 14 in vertically spaced relationship. a plurality of carded slivers are combined together to one sliver 15 which is then passed downward in a serpentine path around the rollers 11 to 14 which provide the wool sufficient heat to raise its temperature to a maximum of about 90° C.

The heat supplied by rollers 11 to 14 effects the wool in at least three different ways that reduces its subsequent friction with the comb teeth during the combing process; it causes the wool fibre to plasticize and therefore to become more flexible, it "irons" the fibres by their contact with the heated rollers so that at least some of the wool crimp is removed and it melts the natural fat of wool which then flows on the surface of the fibre to form a lubricant coating.

As a result of the friction reduction, there is less fibre breakage, and fewer short fibres are in the form of noil. Typically the amount of noil is reduced 1.4 to 2.8% based on the weight of wool combed, compared to the identical process but in which the wool is not heated. Furthermore, the average length of the combed fibres increases (generally by 1 mm) thus resulting in yarns of improved strength.

There exists however, a potential disadvantage with the illustrated apparatus in that if the combing machine should for any reason stop, then there will still be wool in contact with the heated rollers 11 to 14 and prolonged contact with these could result in the deterioration of wool quality.

To overcome this problem, the rollers 11 to 14 are associated with pneumatic actuators (not shown) so that when the machine stops, the actuators move the rollers 11 to 14 from the "closed" position shown in FIG. 1 (in which the wool passes round the rollers) to the "open" position shown in FIG. 2 in which there is no contact between the wool and the heating rollers.

What is claimed is:

1. A method for reduction of noil formation during combing of animal based natural fibers, which comprises heating the fibers upstream to the actual combing process so as to soften or liquify natural fats in such fibers, plastisizing the fibers and lubricating their surface, reducing friction between the fiber and comb during the combing process and reducing noel formation.

2. A method according to claim 1, where the fiber is wool and the step of heating is to below about 90° C. by contact heating, microwaves or any other heating means.

3. A method according to claim 2, the further step of contacting the wool with at least one heated roller to heat the wool.

4. A method according to claim 3, wherein the step of contacting the wool fibers is through a plurality of heated rollers, the path of the fibers being a serpentine one.

5. A device for treating animal based natural fibers prior to conventional combing of such fibers, resulting in a reduction of noil formation during the combing process, which comprises means for heating of such fibers so as to soften or liquify natural fats of such fibers upstream of a combing machine, resulting in a lubrication of the fiber surface, which reduces fiber breakage and noil formation during the combing.

6. A device according to claim 5, the means for heating comprising one or more heated rollers and means for contacting the fibers with said roller or rollers.

7. A device according to claim 6, comprising means for stopping the contact of the fibers during the heating process when the movement of the heated rollers stops.

8. A device according to claim 7, wherein the means for moving heated rollers from contact with the fibers is a pneumatic actuator.

* * * * *

UNITED STATES PATENT AND TRADEMARK OFFICE

CERTIFICATE OF CORRECTION

PATENT NO. : 5,504,975

DATED : April 9, 1996

INVENTOR(S) : Herzel Bar/Amotz Weinberg

It is certified that error appears in the above-identified patent and that said Letters Patent is hereby corrected as shown below: On the title page: Item [22]

in the filing date, delete "Apr. 6, 1996" and substitute therefor --Apr. 6, 1995--.

Signed and Sealed this

Twenty-third Day of July, 1996

Bruce Lehman

*Attest:*

BRUCE LEHMAN

*Attesting Officer*

*Commissioner of Patents and Trademarks*